US005472395A

United States Patent [19]

Trocchio

[11] Patent Number: 5,472,395

[45] Date of Patent: Dec. 5, 1995

[54] MARTIAL ARTS TRAINING APPARATUS

[76] Inventor: Patrick M. Trocchio, 76 S. Clinton Ave., Bay Shore, N.Y. 11706

[21] Appl. No.: 265,789

[22] Filed: Jun. 27, 1994

[51] Int. Cl.[6] ..... A63B 64/34

[52] U.S. Cl. ..... 482/83; 482/87; 482/90

[58] Field of Search ..... 482/83–90; 273/26 E, 273/26 R, 55 R; D21/198, 191

[56] References Cited

U.S. PATENT DOCUMENTS

| | | | |
|---|---|---|---|
| 3,427,021 | 2/1969 | Donato . | |
| 3,804,406 | 4/1974 | Viscione . | |
| 4,077,624 | 3/1978 | Feaser . | |
| 4,201,379 | 5/1980 | Williams . | |
| 4,401,303 | 8/1983 | Anderson . | |
| 4,564,192 | 1/1986 | Lebowitz . | |
| 4,662,630 | 5/1987 | Dignard et al. | 482/83 |
| 4,749,184 | 6/1988 | Tobin | 482/86 |
| 4,787,625 | 11/1988 | Chaloux | 482/87 |
| 4,817,941 | 4/1989 | McCorry | 482/87 |
| 4,913,419 | 4/1990 | McAuliffe | 482/87 |
| 4,946,159 | 8/1990 | Jones . | |
| 5,050,866 | 9/1991 | Fucci . | |
| 5,135,445 | 8/1992 | Christensen et al. | 482/89 |
| 5,183,451 | 2/1993 | Hautamaki . | |
| 5,277,679 | 1/1994 | Wells | 482/83 |
| 5,342,267 | 8/1994 | Adams et al. | 482/83 |

*Primary Examiner*—Jerome W. Donnelly
*Attorney, Agent, or Firm*—Stanley Ira Laughlin

[57] ABSTRACT

The invention relates to a Martial Arts Training Apparatus employing a vertical column, a semicircular screen fastened to the front of the vertical column and covered with a rubber cover which is in turn covered with a leather cover. A heavily padded arm comprising a rod with a spring at one end and heavily padded with rubber and leather is affixed to the column at various heights through spring loaded locking devices. The arms respond to aggressive attacks by the athlete in a different manner dependent upon the direction and thrust of the athlete.

7 Claims, 2 Drawing Sheets

MARTIAL ARTS TRAINING APPARATUS

BACKGROUND OF THE INVENTION

1. Technical Field

The invention relates to apparatus generally employed in the training,exercising and practicing for the Martial Arts and more specifically in the Art of Kickboxing without the necessity of employing the assistance of or endangering other individuals. The inventive apparatus sharpens the individuals' skill and concentration in the planning and execution of aggressive attacks and responds to such attacks with spontaneous and unpredictable movements as a result of such attacks.

2. Brief Description of the Invention

The inventive apparatus comprises a padded shell built around a steel column affixed to the floor and walls, or embedded in a weighted base and which is opened in the back and surrounded in the front by a semi-circular metallic or plastic plurality of vertical parallel bars or screen, heavily padded by rubber and leather except for a vertical slit in the middle of the screen and padding. The column has a plurality of spaced apart apertures extending from the bottom to the top of the column for attaching heavily padded arms, said pads covering a rod, having a spring at one end and attached to the column at the other end through the slits and apertures, and employs spring loaded locking devices, which can be inserted into the column and rod of the arm from the open back of the apparatus. The arm is covered with additional rubber and leather padding behind the main padding so that the athlete will not be hurt while using the apparatus. The arm, depending upon where it is struck by the athlete will react by a response similar to an aggressive attack on the athlete.

SUMMARY OF THE INVENTION

Applicant's invention is a unique Kick-boxer exercising apparatus that does not require anyone else's participation in its use of spring loaded adjustable arms that extend out from the apparatus.

U.S. Pat. No. 4,201,379 to Williams issued May 6, 1980 teaches apparatus for practicing the martial arts by the suspension of a cylindrical practice bag employing arms extending through apertures in the bag. Applicant's invention differs from the Williams apparatus in that it is not a cumbersome suspension device and primarily employs spring loaded arms.

U.S. Pat. No. 5,050,866 to Fucci issued Sep. 24, 1991 teaches an adjustable height punching bag and is only cited as relevant because of its possible use for exercising by Kick-boxers.

U.S. Pat. No. 3,427,021 to Donato issued Feb. 11, 1969 teaches a arm employing springs and telescoping members which react when struck.

U.S. Pat. No. 3,804,406 to Viscione issued Apr. 16, 1974 teaches a mechanical man having electronic circuits to program a sequence of karate moves.

U.S. Pat. No. 4,401,303 to Anderson et al issued Aug. 30, 1983 teaches a human body extending pivotally from a base for use by a training participant to defend when attacked by the Kick-boxer.

U.S. Pat. No. 4,946,159 to Jones issued Aug. 7, 1990 teaches a padded trunk having spring-biased arms that rotate when the pads are struck.

U.S. Pat. No. 4,.077,624 to Feaser issued Mar. 7, 1978 teaches a plurality of target elements that are suspended and will in an unpredictable manner respond when any of the target elements are struck. U.S. Pat. No. 5,183,451 to Hautamaki issued Feb. 2, 1993 teaches a vertical "I" beam comprising a plurality of striking pads positioned over its height.

U.S. Pat. No. 4,564,192 to Lebowitz issued Jan. 14, 1986 teaches apparatus employing simulated arms designed to strike blows against its user.

It is an object of the applicant's invention to provide safe, simple and economical training means for exercising in the Martial Arts and especially in the field of kickboxing.

It is a further object of the applicant's invention to provide fast means for changing the position of the arms of the apparatus.

It is yet a further object of the applicant's invention to provide apparatus that is readily transportable.

DETAILED DESCRIPTION

Figure 1:
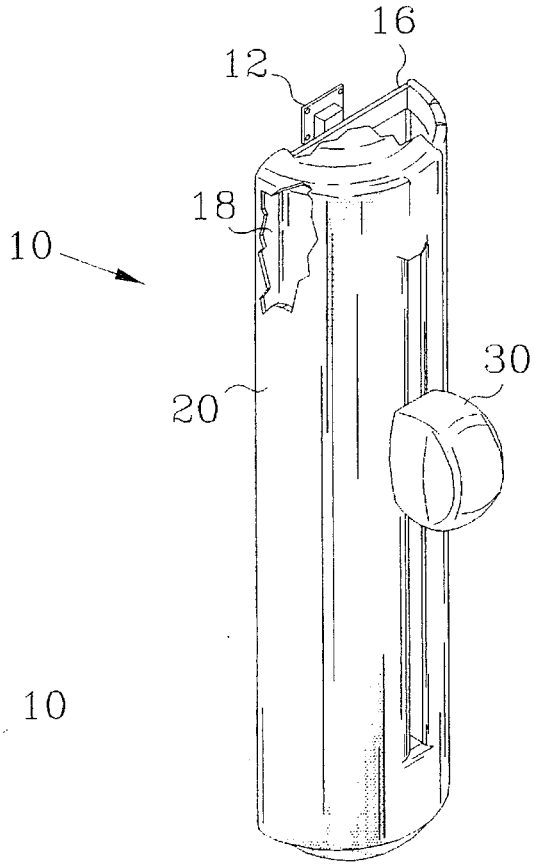
FIG. 1 shows a perspective drawing of the inventive apparatus.
Figure 2:
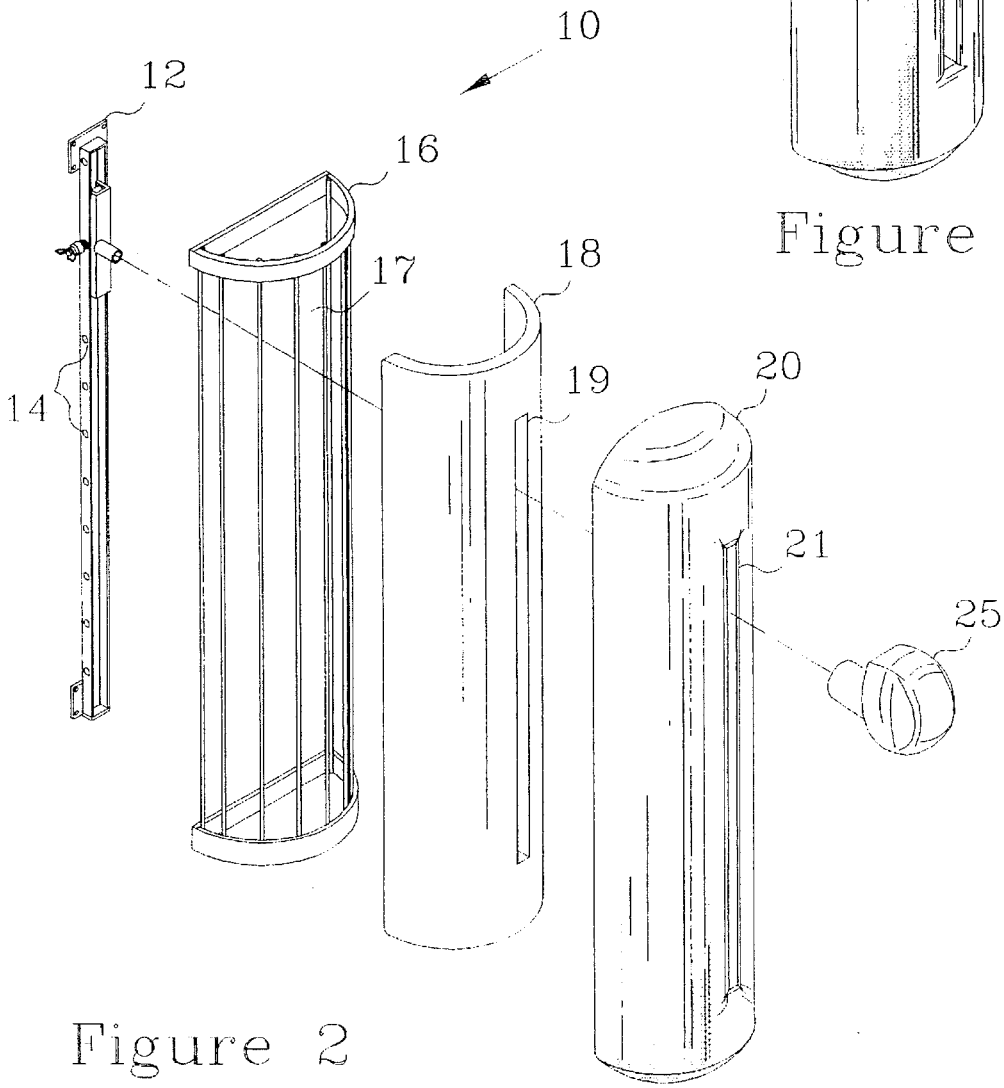
FIG. 2 shows an exploded view of the padded body of the inventive apparatus.
Figure 3:
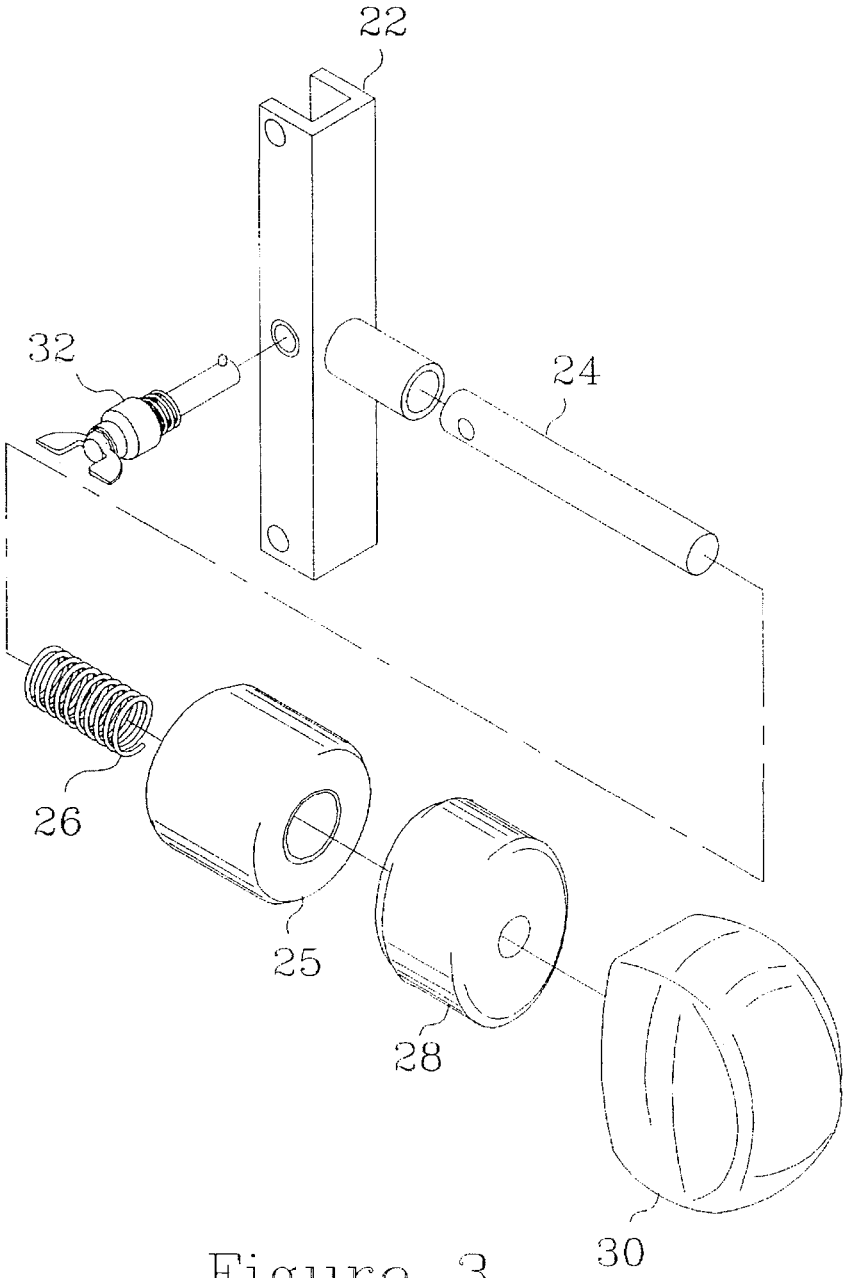
FIG. 3 shows an exploded view of the padded arm of the inventive apparatus.
Figure 4:
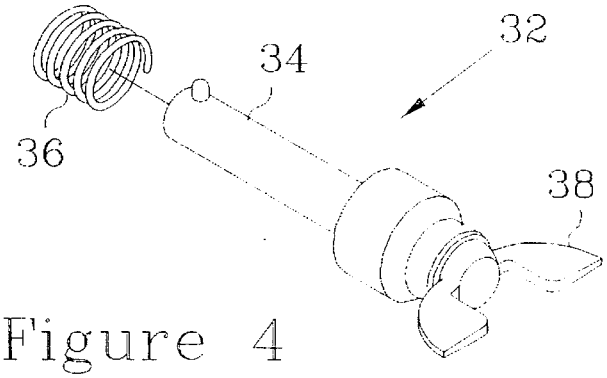
FIG. 4 shows a detail view of one part of the inventive apparatus.

The heavily padded body of the apparatus, as shown in FIGS. 1, 2 and 3, comprises a column 12 having a plurality of vertical apertures 14 and partially encircled by a semi-circular screen, frame means 16 with a vertical slit 17. A rubber covering 18 for the screen 16 having a vertical slit 19 that aligns with vertical slit 17. A leather covering 20 is positioned over rubber covering 18 and having a .vertical slit 21 that aligns with vertical slits 17 and 19 completes the padded body. The column 12 is held in place either by being fastened to the wall or floor, or can be stabilized by employing a concrete or other heavy base. The padded body provides access for affixing the heavily padded arms to the body by being open in the back and through the slits 17, 19, and 21 in the front. A heavily padded arm comprising a rod 24 having a spring 26 at one end covered by cylindrical extra leather packing 25 and a cylindrical rubber 28, which is in turn covered by a leather arm cover 30 can be positioned at various heights through a sleeve 22 which can be moved up and down over column 12. The end of the rod 24 opposite to spring 26 is inserted in any one of the apertures 14 through sleeve 22 and is held in position by spring loaded locking device 32 inserted from in back of the body. The spring loaded locking device 32 comprises a pin 34 which has pressure provided to it by a pin spring 36 and when placed into an aperture in the sleeve which is aligned with an aperture in the arm rod 24 locks the arm into the body until it is released.

Operation of the apparatus is basically simple, because once the athlete has placed the arm into the body, which is stabilized, he has only to train by kicking the heavily padded arm, which responds by springing back after moving either up or down, or from side to side, or any combination of the above. The height of the arm is easily changed by reaching into the open back of the body and releasing the spring loaded locking device 32, and then putting the rod 24 of the arm into another aperture 14 from the front and raising or lowering the sleeve 22 from the back and replacing the spring loaded locking device 32.

Although only one embodiment of applicant's invention has been shown, it is expected that the scope and breadth of applicant's invention will be limited only by the annexed claims:

I claim:

1. A martial arts practice apparatus comprising:

an arm means including a striking surface, an elongated column means having a plurality of spaced apertures, positioned along it's length and means for stabilizing said column in a vertical position, a substantially rigid hemispherically shaped frame means being configured to mount to and encircle the front of said column, leaving the back of said frame means accessible, said frame means further including a vertical, centrally positioned slit means running substantially the length of said frame means, said slit being configured to align vertically with said column when mounted thereto, a rubber covering adapted to mount to, substantially cover, and conform to, an exterior surface of said hemispherically shaped frame means, said rubber covering also including a vertically positioned slit means adapted to align with said vertically positioned slit in said frame means, and a leather covering adapted to mount to and substantially cover and conform to an exterior surface of said rubber covering, said leather covering also including a vertically positioned slit means adapted to align with said vertically positioned slit in said rubber covering, wherein said apparatus further includes, a sleeve means configured to slidable mount on said elongated column means and adapted to support said arm means, said sleeve means further including locking means to mechanically engage the spaced apertures of said elongated column means said arm means further including a first end and a second end, said first end of said arm being configured in the form of a rod and said second end of said arm including said striking surface, wherein said first end of said arm means is configured to be inserted through said rubber and leather covering, said frame means, and to fixedly engage said slidable sleeve means, thereby allowing said arm means to slidably and incrementally be positioned substantially the length of said apparatus.

2. Apparatus as claimed in claim 1 wherein said means for stabilizing said column comprises fastening said column to floor and walls.

3. Apparatus as claimed in claim 1 wherein said means for stabilizing said column comprises a weighted base for said column.

4. Apparatus as claimed in claim 1 wherein said hemispherically shaped frame means comprises a screen.

5. Apparatus as claimed in claim 1 wherein said hemisphericully shaped frame means comprises a plurality of parallel vertical bars.

6. Apparatus as claimed in claim 1 further comprising padding on said arm.

7. A device as claimed in claim 1 wherein said locking means comprises a spring loaded locking device.

* * * * *